United States Patent [19]

Aubort

[11] 4,155,320

[45] May 22, 1979

[54] ZIG ZAG EDGE STITCH

[75] Inventor: Roland Aubort, Geneva, Switzerland

[73] Assignee: Mefina S.A., Fribourg, Switzerland

[21] Appl. No.: 884,290

[22] Filed: Mar. 7, 1978

[30] Foreign Application Priority Data

Mar. 14, 1977 [CH] Switzerland ..... 3142/77

[51] Int. Cl.[2] ..... D05B 1/20

[52] U.S. Cl. ..... 112/269.1; 112/433

[58] Field of Search ..... 112/432, 433, 268, 269, 112/158 A, 158 F, 158 R, 172, 177

[56] References Cited

U.S. PATENT DOCUMENTS

| | | | |
|---|---|---|---|
| 530,218 | 12/1894 | Beardslee | 112/433 |
| 894,567 | 7/1908 | Arbetter | 112/269 X |
| 903,995 | 11/1908 | Lewis | 112/269 X |
| 1,100,507 | 6/1914 | Van Horn | 112/432 |
| 1,992,680 | 2/1935 | Talmadge | 112/269 X |
| 2,010,574 | 8/1935 | Weis | 112/158.12 X |
| 3,362,363 | 1/1968 | Bono | 112/158 R |
| 3,572,270 | 3/1971 | Ketterer | 112/433 |

*Primary Examiner*—Werner H. Schroeder
*Assistant Examiner*—Andrew M. Falik
*Attorney, Agent, or Firm*—Emory L. Groff, Jr.

[57] ABSTRACT

A process for sewing the edge of a woven material to prevent fraying, by sewing alternately at least two stitches along the edge of the material and at least two stitches parallel to the edge of the material but spaced from the edge, with zigzag connecting stitches joining the two rows, where the stitches along the edge and the connecting stitches are sewn in a direction opposite to the stitches parallel to and spaced from the edge.

4 Claims, 3 Drawing Figures

ZIG ZAG EDGE STITCH

The present invention relates to a process for sewing, in the neighbourhood of the edge of a piece of woven material to prevent fraying, using a zigzag stitch sewing machine consisting of sewing alternately at least two stitches along the edge of the material and at least two stitches parallel to the edge of the material, but spaced from the said edge, during a continuous sewing operation.

The stitch thus made is presently called "overlock" and generally serves for stitching edges together, the fixing of hems, the placing of yokes, of elastic, of appliques, etc.

When this stitch is made in the neighbourhood of the edge of a piece of woven material to prevent fraying, the parts of the thread knotted above the edge of the material, which have been sewn in a void, relax and distribute themselves irregularly along the edge of the material from the stitch parallel to this edge, so that the pattern of the stitch is not fully maintained.

The process in accordance with the invention aims to avoid this inconvenience.

According to the present invention there is provided a process for sewing in the edge region of a piece of woven material to prevent fraying, using a zigzag stitch sewing machine, comprising sewing alternately at least two stitches along the edge of the material and at least two stitches parallel to the edge of the material, but spaced from the said edge, during a continuous sewing operation, wherein the stitches parallel to and spaced from the edge of the material are sewn in a direction opposite to the stitches sewn along the edge of the material, and connecting stitches are sewn in the same direction as the stitches sewn along the edge of the material to ensure continuity of the stitching operation.

The present invention will be described further, by way of example, with reference to the accompanying drawings, in which:-

Figure 1:
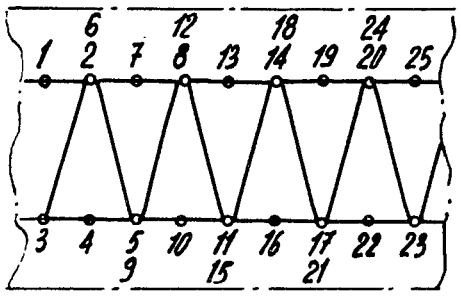
FIG. 1 PRIOR ART
FIG. 1 represents schematically the usual "overlock" stitch, made by stitching in a whole piece of material.

The usual "overlock" stitch represented in FIG. 1 is made, in known manner, on a zigzag stitch sewing machine in which the oscillation of the cradle in which the needle carrying bar is displaced, as well as the direction and amplitude of the transporter for displacing the material to be sewn, are controlled by suitable came. Such a machine is described in the U.S. Pat. No. 2,682,845.

As shown in FIG. 1, the usual "overlock" stitch is obtained in joining two straight stitches 1, 2, 7, 8, 13, 14, 19, 20, 25 and 3, 4, 5, 10, 11, 16, 17, 22, 23, by a zigzag

2-3, 5-6, 8-9, 11-12, 14-15, 17-18, 20-21, 23-24, the formation of this stitching being made continuously by sewing the stitches 1 to 25 successively in numerical order, with reference to FIG. 1.

Figure 2:
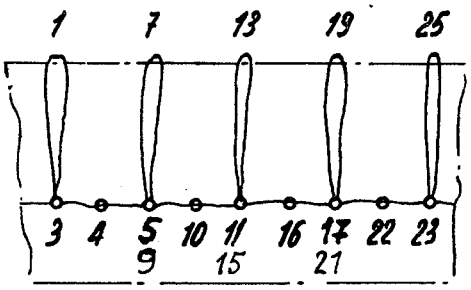
FIG. 2 PRIOR ART
FIG. 2 represents schematically the usual "overlock" stitch, made along the edge of a piece of material to prevent fraying.

In the case where the "overlock" stitch, made in a whole piece of material in FIG. 1, is made along the edge of the material to prevent fraying, the stitches 1, 2, 6, 7, 8, 12, 13, 14, 18, 19, 20, 24, 25 are sewn in a void, which results in a tendency for the stitches 2, 8, 14 and 20 to slide towards the left of FIG. 1 and the stitches 6, 12, 18 and 24 slide towards the right of FIG. 1 and, as illustrated in FIG. 2 and the pattern of the "overlock" stitch is no longer fully maintained in the desired form.

Figure 3:
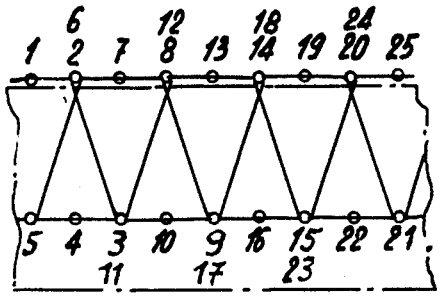
FIG. 3 represents schematically the stitch in accordance with the invention, made along the edge of a piece of material to prevent fraying.

It has been found that by making the "overlock" stitch in accordance with the diagram shown in FIG. 3, this inconvenience is avoided.

In accordance with FIG. 3, the sewing of the stitches 23-22-21, 17-16-15, 11-10-9, 5-4-3, parallel to the edge of the material, is effected by displacement of the material backwards, and the zigzag connecting this stitch to the edge of the material and the stitch along the edge of the material 1-2, 5-6-7-8-9, 11-12-13-14-15, 17-18-19-20-21, etc., are effected by displacement of the material forwardly. There is thus obtained an "overlock" stitch which is maintained in the desired form even when the stitches 1, 2, 6, 7, 8, 12, 13, 14, 18, 19, 20, 24, 25 are sewn in a void.

I claim:

1. A process for sewing in the edge region of a piece of woven material to prevent fraying, using a zigzag stitch sewing machine, comprising sewing alternately at least two stitches along the edge of the material and at least two stitches parallel to the edge of the material, but spaced from the said edge, during a continuous sewing operation, wherein the stitches parallel to and spaced from the edge of the material are sewn in a direction opposite to the stitches sewn along the edge of the material, and connecting stitches are sewn in the same direction as the stitches sewn along the edge of the material to ensure continuity of the stitching operation.

2. A process according to claim 1, wherein the edge stitches and the connecting stitches are sewn as the material is displace forwards and the stitches parallel to and spaced from the edge are sewn as the material is displaced backwards.

3. A piece of woven material when sewn in the edge region to prevent fraying according to the process claimed in claim 1.

4. A piece of woven material having an edge in the region of which two rows of stitches are provided, a first row being along the edge of the material and a second row being parallel to but spaced from said edge, with connecting stitches joining the two rows, wherein said first row and said connecting stitches are sewn in a first direction and said second of stitches are sewn in a second direction opposite to said first direction.

* * * * *